US012234701B2

(12) United States Patent
Karakaya et al.

(10) Patent No.: US 12,234,701 B2
(45) Date of Patent: Feb. 25, 2025

(54) TUBING HANGERS AND RELATED METHODS OF ISOLATING A TUBING

(71) Applicant: Saudi Arabian Oil Company, Dhahran (SA)

(72) Inventors: Mustafa Karakaya, Dhahran (SA); Sohrat Baki, Dhahran (SA); Wafaa Alnakhli, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 234 days.

(21) Appl. No.: 17/942,524

(22) Filed: Sep. 12, 2022

(65) Prior Publication Data

US 2024/0084661 A1 Mar. 14, 2024

(51) Int. Cl.

| | |
|---|---|
| ***E21B 33/03*** | (2006.01) |
| ***E21B 3/04*** | (2006.01) |
| ***E21B 33/04*** | (2006.01) |
| ***E21B 34/02*** | (2006.01) |

(52) U.S. Cl.
CPC ..... *E21B 33/04* (2013.01); *E21B 34/02* (2013.01)

(58) Field of Classification Search
CPC ..... E21B 33/03; E21B 33/04
See application file for complete search history.

(56) References Cited

U.S. PATENT DOCUMENTS

| | | | | |
|---|---|---|---|---|
| 1,641,915 | A * | 9/1927 | Boynton | E21B 33/14 166/325 |
| 2,148,327 | A * | 2/1939 | Smith | E21B 33/03 166/85.4 |
| 2,939,534 | A * | 6/1960 | Allen | E21B 34/02 166/97.1 |
| 4,301,241 | A | 11/1981 | Saito | |
| 4,434,226 | A | 2/1984 | Wilgus et al. | |
| 4,601,343 | A | 7/1986 | Lindsey, Jr. et al. | |
| 4,660,863 | A | 4/1987 | Bailey et al. | |
| 4,739,475 | A | 4/1988 | Mensch | |
| 4,754,810 | A | 7/1988 | Bennett et al. | |
| 4,755,456 | A | 7/1988 | Sugimoto | |
| 4,792,523 | A | 12/1988 | Wong et al. | |
| 4,830,109 | A | 5/1989 | Wedel | |
| 4,914,014 | A | 4/1990 | Daubendiek et al. | |
| 5,279,952 | A | 1/1994 | Wu | |
| 5,318,888 | A | 6/1994 | Weberg et al. | |
| 5,595,864 | A | 1/1997 | Van den Zegel et al. | |
| 5,616,455 | A | 4/1997 | Murphy | |
| 5,702,879 | A | 12/1997 | Barcock | |
| 5,714,323 | A | 2/1998 | Ohshima et al. | |

(Continued)

*Primary Examiner* — Giovanna Wright
(74) *Attorney, Agent, or Firm* — Fish & Richardson P.C.

(57) ABSTRACT

A tubing hanger includes a hanger connection profile positioned along a borehole of the tubing hanger and a first landing profile positioned along the borehole and above the hanger connection profile. The first landing profile includes first threads including a first thread feature configured to secure a first check valve to the tubing hanger for isolating a production tubing. The tubing hanger further includes a second landing profile positioned along the borehole and above the first landing profile, the second landing profile including second threads including a second thread feature. The second thread feature is larger than the first thread feature and is configured to secure a second check valve to the tubing hanger for further isolating the production tubing.

18 Claims, 3 Drawing Sheets

(56) References Cited

U.S. PATENT DOCUMENTS 5,743,335 A 4/1998 Bussear
5,785,120 A 7/1998 Smalley et al.
5,827,177 A 10/1998 Oneda et al.
5,829,524 A 11/1998 Flanders et al.
5,856,733 A 1/1999 Matsumoto et al.
5,954,132 A 9/1999 Harris et al.
5,957,195 A 9/1999 Bailey et al.
6,020,708 A 2/2000 Matsumoto et al.
6,039,120 A 3/2000 Wilkins et al.
6,093,554 A 7/2000 Haute et al.
6,105,673 A 8/2000 Harris et al.
6,142,230 A 11/2000 Smalley et al.
6,197,542 B1 3/2001 Haute et al.
6,220,363 B1 4/2001 Dallas
6,302,208 B1 10/2001 Walker et al.
6,523,110 B1 2/2003 Bright et al.
6,558,892 B2 5/2003 Elst et al.
6,587,187 B2 7/2003 Watanabe et al.
6,621,946 B2 9/2003 Yu et al.
6,668,930 B2 12/2003 Hoffman
6,775,894 B2 8/2004 Hardin
6,825,637 B2 11/2004 Kinpara et al.
6,840,325 B2 1/2005 Stephenson
6,878,549 B1 4/2005 Vogels et al.
7,003,619 B1 2/2006 Moore et al.
7,039,786 B2 5/2006 Suzuki et al.
7,048,125 B2 5/2006 Mize et al.
7,164,999 B2 1/2007 Tabatabaei et al.
7,272,503 B2 9/2007 Strack et al.
7,303,595 B1 12/2007 Janitz
7,308,934 B2 12/2007 Swagerty et al.
7,312,075 B1 12/2007 Yamamura et al.
7,347,840 B2 3/2008 Findlay et al.
PP18,942 P2 6/2008 Boer
PP18,969 P2 6/2008 Boer
7,401,647 B2 7/2008 Baycroft et al.
7,478,679 B2 1/2009 Berzin et al.
7,490,666 B2 2/2009 Swagerty et al.
7,614,448 B2 11/2009 Swagerty et al.
7,615,355 B2 11/2009 Papadopoulos et al.
7,633,992 B1 12/2009 Miao et al.
7,730,940 B2 6/2010 Knippa et al.
7,743,824 B2 6/2010 Lam et al.
7,823,634 B2 11/2010 Chan et al.
7,861,775 B2 1/2011 Palmer et al.
7,900,697 B2 3/2011 Swagerty et al.
7,934,550 B2 5/2011 Bolding et al.
7,954,793 B2 6/2011 Weisbeck et al.
7,997,338 B2 8/2011 Foster et al.
8,087,459 B2 1/2012 Caldwell et al.
8,117,819 B2 2/2012 Scott
8,127,978 B2 3/2012 Castillo et al.
8,136,604 B2 3/2012 Jennings
8,157,006 B2 4/2012 Koleilat et al.
8,194,885 B2 6/2012 Brannmark et al.
8,225,861 B2 7/2012 Foster et al.
8,235,108 B2 8/2012 Lemme et al.
8,251,142 B2 8/2012 Hinkie
8,302,678 B2 11/2012 Swagerty et al.
8,327,943 B2 12/2012 Borak et al.
8,371,374 B2 2/2013 Foster et al.
8,396,667 B2 3/2013 Nutley et al.
8,397,802 B2 3/2013 Lembcke
8,499,842 B2 8/2013 Nguyen et al.
8,506,932 B2 8/2013 Arstad et al.
8,550,156 B2 10/2013 Castillo et al.
8,646,533 B2 2/2014 Nguy et al.
8,674,637 B2 3/2014 Kamijo
8,678,406 B1 3/2014 Albertson
8,727,012 B2 5/2014 Bhat
8,794,310 B2 8/2014 Allen et al.
8,823,558 B2 9/2014 Barrett
8,899,316 B2 12/2014 Krawiec et al.
8,910,709 B2 12/2014 Thomson et al.
8,936,075 B2 1/2015 Guidry
9,051,539 B2 6/2015 Synder et al.
9,168,317 B2 10/2015 Jones
9,194,201 B2 11/2015 Simson et al.
9,200,498 B2 12/2015 Klimack
9,243,473 B2 1/2016 Yang et al.
9,284,812 B2 3/2016 Mazyar et al.
9,314,541 B2 4/2016 Jones
9,447,671 B2 9/2016 Nguyen et al.
9,523,256 B2 12/2016 Bilansky et al.
9,587,460 B2 3/2017 Clemens
9,637,997 B2 5/2017 Goodman et al.
9,695,659 B2 7/2017 Davis et al.
9,770,046 B2 9/2017 Negri
9,909,381 B2 3/2018 Kajaria et al.
9,925,825 B1 3/2018 Hoffman et al.
9,976,380 B2 5/2018 Davis et al.
10,060,283 B2 8/2018 Tomigashi et al.
10,132,141 B2 11/2018 Caccialupi et al.
10,159,841 B2 12/2018 Chin et al.
10,173,936 B2 1/2019 Flato et al.
10,230,430 B2 3/2019 Uchino et al.
10,287,846 B2 5/2019 Andersen et al.
10,319,092 B2 6/2019 Wu et al.
10,364,635 B2 7/2019 Puccio et al.
10,447,070 B2 10/2019 Qin et al.
10,450,832 B2 10/2019 Hickie
10,487,302 B2 11/2019 Spangenburg et al.
10,487,607 B2 11/2019 Kajaria et al.
10,604,693 B2 3/2020 Kim et al.
10,612,349 B2 4/2020 Clemens
10,633,966 B2 4/2020 Pollak et al.
10,655,423 B2 5/2020 Stein et al.
10,662,762 B2 5/2020 Alnughaimish et al.
10,677,011 B2 6/2020 Al-AbdulJabbar et al.
10,724,344 B2 7/2020 Dietz
10,738,560 B2 8/2020 Duan et al.
10,743,590 B2 8/2020 Moussa et al.
10,753,173 B2 8/2020 Voll et al.
10,780,659 B2 9/2020 Ahrenholtz
RE48,308 E 11/2020 Flato et al.
10,837,264 B2 11/2020 Filippov et al.
10,893,527 B2 1/2021 Lee et al.
10,947,813 B2 3/2021 Ejim et al.
10,966,224 B2 3/2021 Yu et al.
10,982,499 B2 4/2021 Alshuraim
11,041,357 B2 6/2021 Pounds
11,053,769 B2 7/2021 Craycraft
11,058,837 B2 7/2021 Stam et al.
11,096,194 B2 8/2021 Tang
11,142,732 B2 10/2021 Spangenburg et al.
11,174,700 B2 11/2021 Fripp et al.
11,193,357 B2 12/2021 Clemens
11,268,342 B2 3/2022 Andersen et al.
11,293,270 B2 4/2022 Malone et al.
11,299,955 B2 4/2022 Fripp et al.
11,365,599 B2 6/2022 Glaesman
11,437,156 B2 9/2022 Russell, II et al.
11,440,521 B2 9/2022 Thiel
2002/0119942 A1 8/2002 Vogels et al.
2003/0100100 A1 5/2003 Jacobs, Jr. et al.
2003/0157095 A1 8/2003 Papadopoulos et al.
2004/0129429 A1* 7/2004 Dallas ..... E21B 33/12 166/85.4
2004/0210790 A1 10/2004 Moon et al.
2005/0051341 A1* 3/2005 Khazanovich ..... E21B 33/0385 166/85.1
2005/0074885 A1 4/2005 Vogels et al.
2005/0077043 A1* 4/2005 Dallas ..... E21B 33/068 166/308.1
2006/0106202 A1 5/2006 Papadopoulos et al.
2006/0238437 A1 10/2006 Huang
2008/0169097 A1* 7/2008 Bolding ..... E21B 33/072 166/263
2008/0177592 A1 7/2008 Masuyama et al.
2008/0254372 A1 10/2008 Wu
2008/0254373 A1 10/2008 Wu
2010/0015114 A1 1/2010 Papadopoulos et al.
2010/0068779 A1 3/2010 Wells et al.
2010/0258311 A1 10/2010 Craig et al.

(56) References Cited

U.S. PATENT DOCUMENTS

2011/0081295 A1 4/2011 Papadopoulos et al.
2012/0012343 A1 1/2012 Wilkin et al.
2013/0105388 A1 5/2013 Johnson et al.
2013/0288228 A1 10/2013 Anderson et al.
2014/0058677 A1 2/2014 Combee
2014/0246197 A1* 9/2014 Smith ..... E21B 43/162 166/305.1
2015/0012664 A1 1/2015 Johnson
2015/0041126 A1 2/2015 Boyle et al.
2015/0041129 A1 2/2015 Mani et al.
2015/0073523 A1 3/2015 Chobotov
2015/0090255 A1 4/2015 Gulliver et al.
2015/0233204 A1* 8/2015 Tarlton ..... E21B 33/0407 166/65.1
2015/0278138 A1 10/2015 Seidel et al.
2015/0347246 A1 12/2015 Matsui et al.
2015/0378937 A1 12/2015 Yang et al.
2018/0124634 A1 5/2018 Jose et al.
2018/0171740 A1 6/2018 Casanova
2018/0313182 A1 11/2018 Cherewyk et al.
2019/0055839 A1 2/2019 Skillingstad et al.
2019/0321264 A1 10/2019 Gulliver et al.
2020/0003032 A1 1/2020 Chen et al.
2020/0375265 A1 12/2020 Moussa et al.
2021/0108478 A1 4/2021 Filippov et al.
2021/0108490 A1 4/2021 Filippov et al.
2021/0324699 A1 10/2021 Trumbull et al.
2021/0370000 A1 12/2021 Stam et al.
2022/0068512 A1 3/2022 Russell, II et al.
2022/0081986 A1 3/2022 Roselier et al.
2022/0086848 A1 3/2022 Sharma et al.
2022/0299151 A1 9/2022 Lee et al.

* cited by examiner

TUBING HANGERS AND RELATED METHODS OF ISOLATING A TUBING

TECHNICAL FIELD

This disclosure relates to tubing hangers, such as tubing hangers equipped with a primary BPV and a secondary BPV for isolating a production tubing or casing.

BACKGROUND

A back-pressure valve (BPV) is a type of one-way check valve that can be installed to tubing hanger to isolate an attached production tubing during a well kill operation at a wellbore. For example, the BPV can restrict fluid pressure to or contain fluid pressure within the production tubing while performing well activities, such as replacing a tree (e.g., production, Christmas, or frac tree) at the wellbore or master valves during installation, maintenance, or removal processes. During such processes, an additional isolation barrier is required to ensure that fluid pressure within the production tubing does not breach the BPV. To effect the additional barrier, a slickline intervention is often performed to run a permanent or retrievable plug in the wellbore. Slickline interventions of this nature are time-consuming, equipment-intensive, human-resource-intensive, risky, and costly.

SUMMARY

This disclosure relates to tubing hangers. An example tubing hanger includes two landing profiles that each include universal back pressure valve (BPV) threads for respectively accommodating two BPVs. The serial BPV arrangement is designed to isolate a production tubing secured to the tubing hanger. The secondary (e.g., uphole) landing profile is wider than the primary (e.g., downhole) landing profile and fulfils multiple purposes of accommodating a secondary BPV and a two-way check valve.

In one aspect, a tubing hanger includes a hanger connection profile positioned along a borehole of the tubing hanger and a first landing profile positioned along the borehole and above the hanger connection profile. The first landing profile includes first threads including a first thread feature configured to secure a first check valve to the tubing hanger for isolating a production tubing. The tubing hanger further includes a second landing profile positioned along the borehole and above the first landing profile, the second landing profile including second threads including a second thread feature. The second thread feature is larger than the first thread feature and is configured to secure a second check valve to the tubing hanger for further isolating the production tubing.

Embodiments may provide one or more of the following features.

In some embodiments, the first check valve includes a first back-pressure valve (BPV) and the second check valve includes a second BPV.

In some embodiments, the first threads include standard BPV threads and the second threads include standard BPV threads.

In some embodiments, the second landing profile further includes a shoulder disposed above the second threads.

In some embodiments, the second landing profile further includes a polished surface area adjacent the second threads.

In some embodiments, the second landing profile is wider than the first landing profile.

In some embodiments, the second landing profile further includes a shoulder disposed above the second threads.

In some embodiments, the borehole has a non-constant diameter.

In some embodiments, the first check valve includes a BPV and the second check valve includes a two-way check valve.

In some embodiments, tubing hanger further includes a wall that defines the borehole.

In some embodiments, the wall includes a first wall portion that defines the first and second landing profiles.

In some embodiments, the wall includes a second wall portion that defines the hanger connection profile.

In some embodiments, the tubing hanger further includes a first seal that surrounds the first wall portion and a second seal that surrounds the second wall portion.

In another aspect, a system includes a first check valve and a second check valve, a production tubing, and a tubing hanger. Tubing hanger includes a hanger connection profile positioned along a borehole of the tubing hanger and a first landing profile positioned along the borehole and above the hanger connection profile. The first landing profile includes first threads including a first thread feature configured to secure the first check valve to the tubing hanger for isolating the production tubing. The tubing hanger further includes a second landing profile positioned along the borehole and above the first landing profile, the second landing profile including second threads including a second thread feature. The second thread feature is larger than the first thread feature and is configured to secure a second check valve to the tubing hanger for further isolating the production tubing.

In another aspect, a method of isolating a tubing includes securing the tubing to a hanger connection profile along a borehole of a tubing hanger and securing a first check valve to first threads of a first landing profile along the borehole and above the hanger connection profile, the first threads including a first thread feature. The method further includes securing a second check valve to second threads of a second landing profile along the borehole and above the first landing profile, the second threads including a second thread feature. The method further includes pumping a first fluid in a downhole direction through the second check valve and the first check valve into the tubing without permitting a second fluid within the tubing to flow in an uphole direction through the first check valve.

Embodiments may provide one or more of the following features.

In some embodiments, the method further includes isolating the tubing from wellhead equipment positioned uphole of the tubing hanger.

In some embodiments, the first check valve includes a first back-pressure valve (BPV) and the second check valve includes a second BPV.

In some embodiments, the first check valve includes a BPV and the second check valve includes a two-way check valve.

In some embodiments, the method further includes pressure testing wellhead equipment positioned uphole of the tubing hanger.

In some embodiments, the second landing profile is wider than the first landing profile.

The details of one or more embodiments are set forth in the accompanying drawings and description. Other features, aspects, and advantages of the embodiments will become apparent from the description, drawings, and claims.

DETAILED DESCRIPTION

Figure 1:
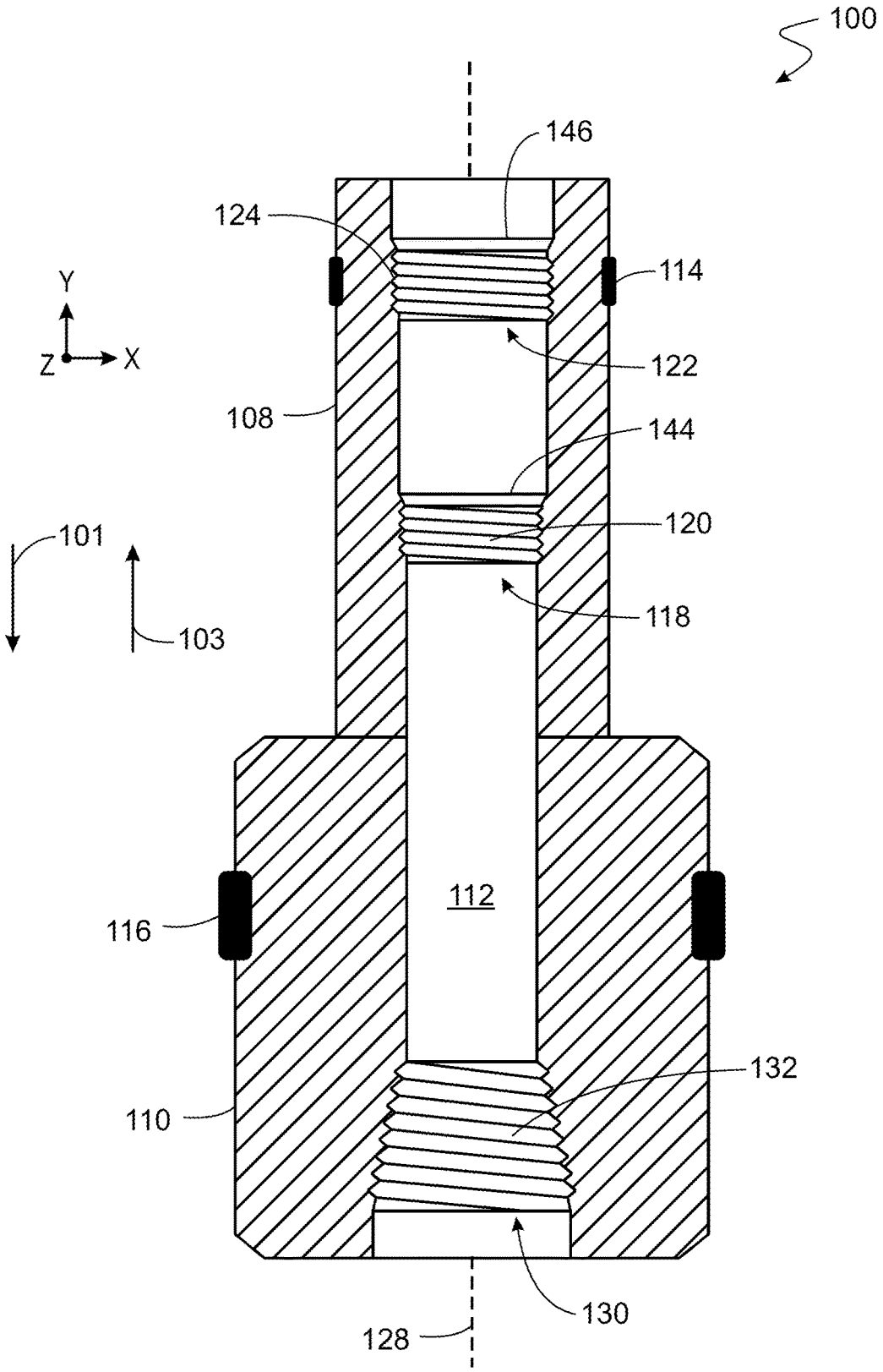
FIG. 1 is a cross-sectional view of an example tubing hanger.
Figure 2:
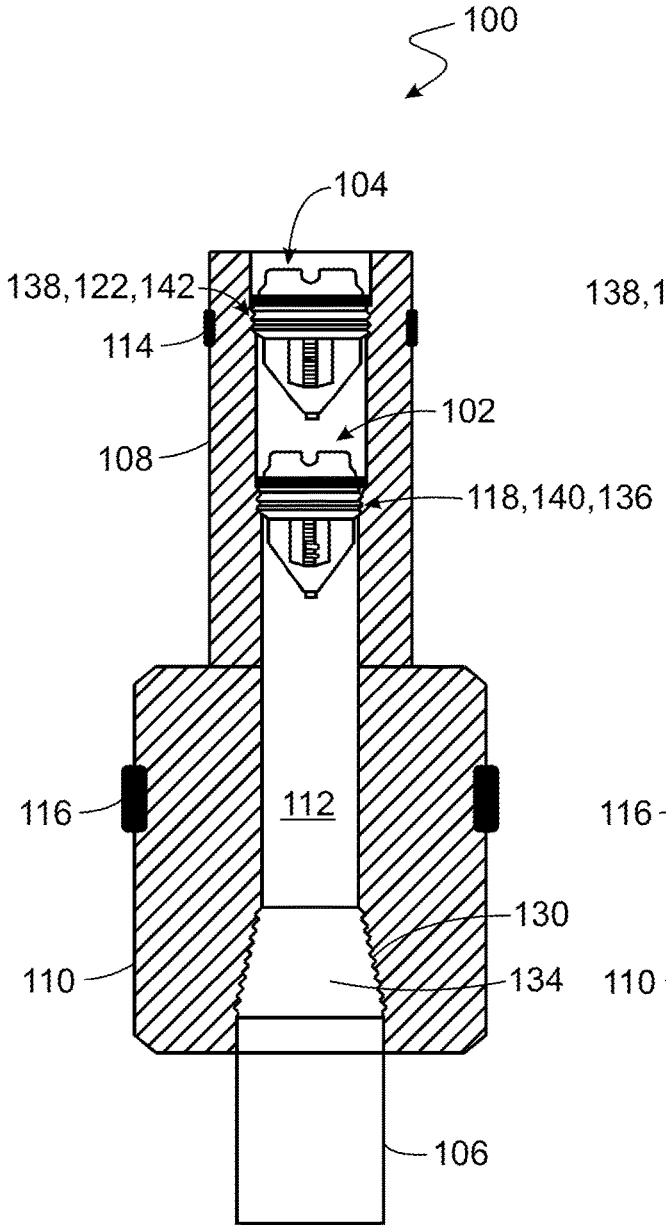
FIG. 2 is a cross-sectional view of the tubing hanger of FIG. 1, with a primary back-pressure valve (BPV), a secondary BPV, and a production tubing installed.

FIGS. 1 and 2 illustrate cross-sectional views of an example tubing hanger 100. The tubing hanger 100 is designed to accommodate a first back-pressure valve BPV 102 and a second BPV 104 for isolating a production tubing 106 that is secured to the tubing hanger 100. The tubing hanger 100 includes an upper wall portion 108 and a lower wall portion 110 that together define a bore 112 of variable diameter. The upper and lower wall portions 108, 110 are substantially tubular in shape and accordingly have a substantially annular cross-sectional shape (e.g., in an xz plane) with respect to a central axis 128 of the tubing hanger 100. The upper and lower wall portions 108, 110 are equipped with (e.g., surrounded by) upper and lower seals 114, 116 at which the upper and lower wall portions 108, 110 seal to respective surrounding casing joints. The lower wall portion 110 is wider and has a larger wall thickness than the upper wall portion 108.

The upper wall portion 108 defines a first landing profile 118 (e.g., a landing profile) for accommodating the first BPV 102. The first landing profile 118 accordingly includes threads 120 that are formed as standard (e.g., or universal) BPV threads. In general, a pitch of the threads 120 will vary, depending on a size of the production tubing 106 and a size of the wellhead. The first landing profile 118 includes a shoulder 144 that is located directly above the threads 120 at a polished area and that provides a seating surface for the first BPV 102. A diameter of the first landing profile 118 gradually decreases in a downhole direction 101 from an upper end of the shoulder 144 to a lower end of the threads 120.

The upper wall portion 108 also defines a second landing profile 122 (e.g., a landing profile) for accommodating the second BPV 104. The second landing profile 122 accordingly includes threads 124 that are formed as standard BPV threads. In some embodiments, the threads 124 have a pitch that is larger than the pitch of the threads 120. The second landing profile 122 includes a shoulder 146 that is located directly above the threads 124 at a polished area and that provides a seating surface for the second BPV 104. A diameter of the second landing profile 122 gradually decreases in the downhole direction 101 from an upper end of the shoulder 146 to a lower end of the threads 124. The first and second landing profiles 118, 122 are spaced apart by a distance large enough to allow for space between the BPVs 102, 104.

The lower wall portion 110 defines a hanger connection profile 130 at which the production tubing 106 is secured to the tubing hanger 100. The hanger connection profile 130 includes threads 132 that are formed to mate with a connector 134 of the production tubing 106. A diameter of the hanger connection profile 130 gradually increases in the downhole direction 101 from an upper end of the hanger connection profile 130 to a lower end of the hanger connection profile 130. In some embodiments, the diameter of the hanger connection profile 130 at its upper end is about equal to the diameter of the first landing profile 118 at its lower end such that the bore 112 has a substantially constant diameter between the first landing profile 118 and the hanger connection profile 130. The first landing profile 118 and the hanger connection profile 130 are spaced apart by a distance large enough to allow for space between the BPV 102 and the production tubing 106.

Referring to FIG. 2, the BPVs 102, 104 are check valves that are designed to isolate the production tubing 106 by holding down pressure within the production tubing 106 while allowing one-way flow through the BPVs 102, 104 in the downhole direction 101. Each BVP 102, 104 is respectively equipped with an elastomeric sealing element 136, 138 formed as an outer ring that engages a polished inner surface (e.g., of about 1 cm to about 2 cm in height) of the upper wall 108 just above the threads 120, 124. The elastomeric sealing elements 136, 138 effectively lower amounts of torque that would otherwise need to be applied to the BPVs 102, 104 to sufficiently seal the BPVs 102, 104 to the first and second landing profiles 118, 122, respectively.

The BPVs 102, 104 may be utilized to provide isolation during an operation to kill the surrounding well with kill fluid. The first BPV 102 is a primary BPV and is located below (e.g., downhole of) the second BPV 104. The second BPV 104 is a secondary BPV that may be optionally installed to the tubing hanger 104 to form a serial arrangement with the BPV 102 (e.g., without any intervening isolation or other components) that provides an additional isolation barrier to the production tubing 106 when desired. The second BPV 104 is larger (e.g., in diameter) than the first BPV 102 such that the second BPV 104 can mechanically withstand larger loads. The BPVs 102, 104 include first and second threads 140, 142, respectively, at which the BPVs 102, 104 engage (e.g., mate) with the tubing hanger 100 at the first and second threads 120, 124 of the first and second landing profiles 118, 122.

Inclusion of the second landing profile 122 in the tubing hanger 100 for accommodating the second BPV 104 provides a robust backup (e.g., contingency) isolation mechanism in case the first BPV 102 fails. The second BPV 104, being a one-way check valve, also has a pump-through capacity that is similar to that of the first BPV 102. Inclusion of the second landing profile 122 also eliminates multiple slickline intervention operations that would otherwise need to be performed for installing and retrieving an additional isolation barrier (e.g., a plug or another barrier) below a conventional tubing hanger (e.g., including only a single BPV profile) in order to protect a tree (e.g., production, Christmas, or fraccing) and master valves located uphole of the tubing hanger at the wellhead. This design accordingly eliminates significant time delays, costs, safety risks, and equipment risks that would be associated with such intervention operations. The second landing profile 122 is also constructed to be compatible with high-rate fracking operations and larger (e.g., wider) bores, trees, and frac adapter bonnets. By accelerating these rigless operations, the second landing profile 122 increases the success of unconventional operations without compromising isolation of the production tubing.

Figure 3:
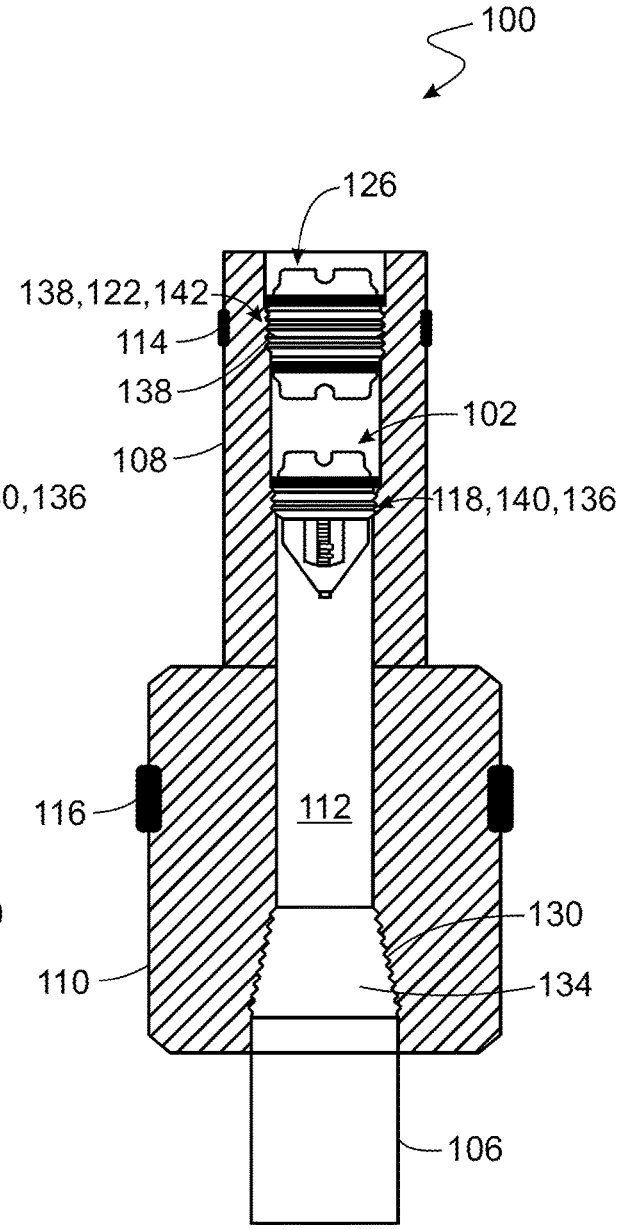
FIG. 3 is a cross-sectional view of the tubing hanger of FIG. 1, with a primary BPV, a two-way check valve, and a production tubing installed.

Referring to FIG. 3, in addition to being sized and otherwise designed to accommodate the second BPV 104, the design of the second landing profile 122 also accommodates (e.g., optionally) a two-way check valve (TWCV) 126 (e.g., including threads 148) that can be installed without retrieving the first BPV 102. Installation of the TWCV 126 in this manner enables efficient pressure testing of wellhead equipment. In this way, the second landing profile 122 is a multipurpose landing joint that flexibly provides different functionalities to the tubing hanger 100.

Figure 4:
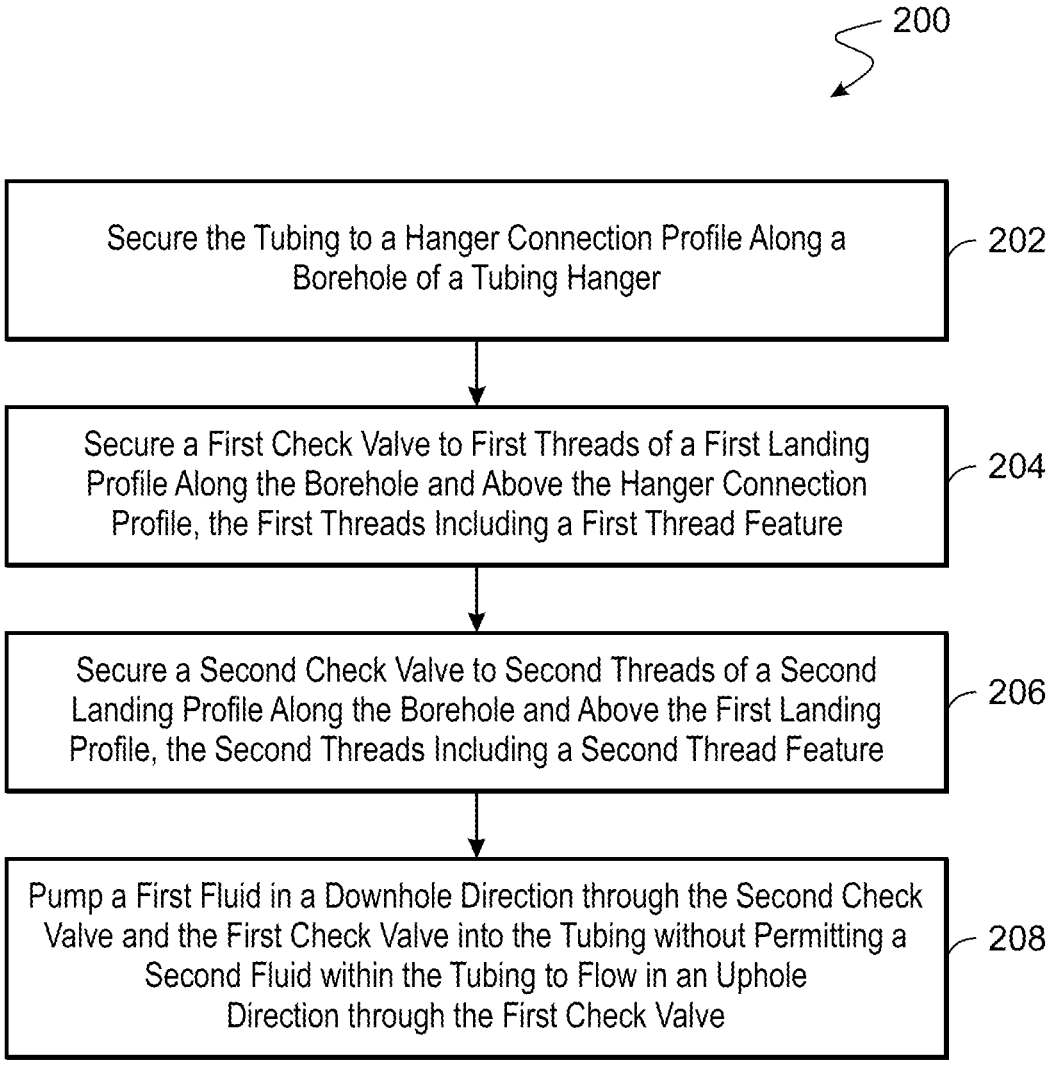
FIG. 4 is a flow chart illustrating an example method of isolating a tubing using the tubing hanger of FIG. 1.

FIG. 4 is a flow chart illustrating an example method 200 of isolating a tubing (e.g., the production tubing 106). In some embodiments, the method 200 includes a step 202 for securing the tubing to a hanger connection profile (e.g., the hanger connection profile 130) along a borehole (e.g., the bore 112) of a tubing hanger (e.g., the tubing hanger 100). In some embodiments, the method 200 includes a step 204 for securing a first check valve (e.g., the first BPV 100) to first threads (e.g., the threads 120) of a first landing profile (e.g., the first landing profile 118) along the borehole and above the hanger connection profile, the first threads including a first thread feature (e.g., a pitch, a diameter, or another feature). In some embodiments, the method 200 includes a step 206 for securing a second check valve (e.g., the BPV 104, the TWCV 126) to second threads (e.g., the threads 124) of a second landing profile (e.g., the second landing profile 122) along the borehole and above the first landing profile, the second threads including a second thread feature (e.g., a pitch, a diameter, or another feature). In some embodiments, the method 200 includes a step 208 for pumping a first fluid in a downhole direction (e.g., the downhole direction 101) through the second check valve and the first check valve into the tubing without permitting a second fluid within the tubing to flow in an uphole direction 103 through the first check valve.

While the tubing hanger 100 has been described and illustrated with respect to certain dimensions, sizes, shapes, arrangements, materials, methods 200, and check valves 102, 104, 126, in some embodiments, a tubing hanger 100 that is otherwise substantially similar in construction and function to the tubing hanger 100 may include one or more different dimensions, sizes, shapes, arrangements, configurations, and materials or may be utilized according to different methods or with different valves. Accordingly, other embodiments are also within the scope of the following claims.

What is claimed is:

1. A system comprising:

a first check valve and a second check valve; and a tubing hanger comprising:

a hanger connection profile positioned along a borehole of the tubing hanger;

a first landing profile positioned along the borehole and above the hanger connection profile, the first landing profile comprising first threads including a first thread feature configured to secure the first check valve to the tubing hanger for isolating a production tubing; and a second landing profile positioned along the borehole and above the first landing profile, the second landing profile being wider than the first landing profile and comprising second threads including a second thread feature, the second thread feature being larger than the first thread feature and being configured to secure the second check valve to the tubing hanger for further isolating the production tubing, wherein the tubing hanger is configured such that when a first fluid is pumped in a downhole direction through the second check valve and the first check valve into the tubing, a second fluid within the tubing is not permitted to flow in an uphole direction through the first check valve.

2. The system of claim 1, wherein the first check valve comprises a first back-pressure valve (BPV) and the second check valve comprises a second BPV.

3. The system of claim 2, wherein the first threads comprise standard BPV threads and the second threads comprise standard BPV threads.

4. The system of claim 1, wherein the second landing profile further comprises a shoulder disposed above the second threads.

5. The system of claim 1, wherein the second landing profile further comprises a polished surface area adjacent the second threads.

6. The system of claim 5, wherein the second landing profile further comprises a shoulder disposed above the second threads.

7. The system of claim 1, wherein the borehole has a non-constant diameter.

8. The system of claim 1, wherein the first check valve comprises a BPV and the second check valve comprises a two-way check valve.

9. The system of claim 1, wherein the tubing hanger further comprises a wall that defines the borehole.

10. The system of claim 9, wherein the wall comprises a first wall portion that defines the first and second landing profiles.

11. The system of claim 10, wherein the wall comprises a second wall portion that defines the hanger connection profile.

12. The system of claim 11, wherein the tubing hanger further comprises a first seal that surrounds the first wall portion and a second seal that surrounds the second wall portion.

13. The system of claim 1, further comprising the production tubing.

14. A method of isolating a tubing, the method comprising:

securing the tubing to a hanger connection profile along a borehole of a tubing hanger;

securing a first check valve to first threads of a first landing profile along the borehole and above the hanger connection profile, the first threads including a first thread feature;

securing a second check valve to second threads of a second landing profile along the borehole and above the first landing profile, the second threads including a second thread feature, and the second landing profile being wider than the first landing profile; and pumping a first fluid in a downhole direction through the second check valve and the first check valve into the tubing without permitting a second fluid within the tubing to flow in an uphole direction through the first check valve.

15. The method of claim 14, further comprising isolating the tubing from wellhead equipment positioned uphole of the tubing hanger.

16. The method of claim 14, wherein the first check valve comprises a first back-pressure valve (BPV) and the second check valve comprises a second BPV.

17. The method of claim 14, wherein the first check valve comprises a BPV and the second check valve comprises a two-way check valve.

18. The method of claim 17, further comprising pressure testing wellhead equipment positioned uphole of the tubing hanger.

* * * * *